US009305693B2

(12) United States Patent
Bürβner et al.

(10) Patent No.: US 9,305,693 B2
(45) Date of Patent: Apr. 5, 2016

(54) BISTABLE ELECTROMAGNETIC ACTUATING APPARATUS, ARMATURE ASSEMBLY AND CAMSHAFT ADJUSTMENT APPARATUS

(71) Applicant: ETO MAGNETIC GMBH, Stockach (DE)

(72) Inventors: Jörg Bürβner, Engen (DE); Philipp Fangauer, Konstanz (DE); Peter Vincon, Stockach (DE)

(73) Assignee: ETO MAGNETIC GMBH, Stockach (DE)

( * ) Notice: Subject to any disclaimer, the term of this patent is extended or adjusted under 35 U.S.C. 154(b) by 0 days.

(21) Appl. No.: 14/420,098

(22) PCT Filed: May 31, 2013

(86) PCT No.: PCT/EP2013/061310

§ 371 (c)(1),
(2) Date: Feb. 6, 2015

(87) PCT Pub. No.: WO2014/023451

PCT Pub. Date: Feb. 13, 2014

(65) Prior Publication Data

US 2015/0213936 A1 Jul. 30, 2015

(30) Foreign Application Priority Data

Aug. 8, 2012 (DE) ..... 10 2012 107 281

(51) Int. Cl.
*F01L 9/04* (2006.01)
*H01F 7/122* (2006.01)
(Continued)

(52) U.S. Cl.
CPC ..... *H01F 7/122* (2013.01); *F01L 13/0015* (2013.01); *F01L 13/0036* (2013.01); *H01F 7/1646* (2013.01); *F01L 2013/0052* (2013.01); *F01L 2820/031* (2013.01)

(58) Field of Classification Search
CPC ..... H01F 7/122; H01F 7/1646; H01F 2013/0052; F01L 13/0015; F01L 13/0036; F01L 2820/031
USPC ..... 123/90.11
See application file for complete search history.

(56) References Cited

U.S. PATENT DOCUMENTS 6,026,771 A * 2/2000 Escobosa ..... F01L 9/02 123/90.11
6,392,516 B1 5/2002 Ward et al.
(Continued)

FOREIGN PATENT DOCUMENTS

DE 3019418 A1 11/1981
DE 20114466 U1 1/2002
(Continued)

*Primary Examiner* — Zelalem Eshete
(74) *Attorney, Agent, or Firm* — Bachman & LaPointe, P.C.

(57) ABSTRACT

A bistable electromagnetic actuating apparatus (1) having an actuating element (2), which forms an engagement region (4) at the end and can be moved axially between two end positions, in particular for engaging in a control groove in a cam of an internal combustion engine, and having a coil device (11) which is provided in a stationary manner relative to the actuating element (2) and is designed to exert a force on said actuating element, wherein the actuating element (2) has permanent magnets (5) which are designed to interact with a core region (3) which is provided in a stationary manner relative to the actuating element (2), and wherein the coil device (11) is designed to generate a counterforce, which counteracts a retaining force of the permanent magnets (5) and releases said permanent magnets from the core region (3), in response to an electronic actuation signal, and wherein a spring is arranged such that it applies a spring force to the actuating element (2) in an axial direction which faces away from the core region (3).

7 Claims, 4 Drawing Sheets

(51) Int. Cl.
*F01L 13/00* (2006.01)
*H01F 7/16* (2006.01)

(56) References Cited

U.S. PATENT DOCUMENTS 6,967,550 B2 11/2005 Elendt et al.
8,228,149 B2 7/2012 Puth et al.
8,707,917 B2 4/2014 Schiepp

FOREIGN PATENT DOCUMENTS

DE 102006059188 A1 6/2008
DE 102008000534 A1 9/2009
DE 102009015833 A1 10/2010
DE 202009011804 U1 1/2011
EP 0794540 A1 9/1997
GB 2197754 A 5/1988

* cited by examiner

BISTABLE ELECTROMAGNETIC ACTUATING APPARATUS, ARMATURE ASSEMBLY AND CAMSHAFT ADJUSTMENT APPARATUS

BACKGROUND OF THE INVENTION

The invention relates to a bistable electromagnetic actuating device, an armature assembly for an electromagnetic actuating device and a camshaft adjustment device.

DE 201 14 466 U1 shows a bistable electromagnetic actuating device for use for example in the camshaft adjustment devices described in DE 20 2009 011 804 U1. The known bistable electromagnetic actuating device is distinguished in that permanent magnet means are provided on an actuating element, which comprise two pole discs and an axially magnetised permanent magnet ring located therebetween. The permanent magnet means interact with a stationary core region, generating an attractive force together, permanent magnet means and core region being located opposite one another in a core-region-side end position. In this end position, a compression spring loading the actuating element with force away from the core region is maximally prestressed. In order to then overcome the retaining force of the permanent magnet means, a stationary coil apparatus is powered, wherein upon overcoming the adhesive force, the actuating element is additionally accelerated by the compression spring in the direction of the opposite end position, in which the piston-like actuating element engages with an end-side engagement region into the control groove of a cam of an internal combustion engine.

The known bistable electromagnetic actuating device has proven itself. However, the comparatively small travel ranges of the actuating element, in which the actuating element (permanent magnet armature) can move independently and without external influence into the core-region-side end position thereof, are found to be disadvantageous.

In the unpowered state of the coil apparatus, the permanent magnet means show a hyperbolic force-travel curve, in which, close to the core-region-side end position, the magnetic force rises steeply, but conversely falls quickly with increasing travel.

This is disadvantageous for spring-assisted bistable actuating devices, as only a small part of the available magnetic work can be used to prestress the spring, i.e. the travel range, in which sufficient permanent magnetic force is available in order to independently pull the actuating element provided with permanent magnet means back to the core-region-side end position is very narrow. Thus, in the case of known electromagnetic actuating devices, compression springs with very steep force-path characteristics must be used, in order to return the actuating element in the direction of the core-region-side travel initial position. There are also demands for an ever shorter travel time of the actuating element in the direction of the travel end position facing away from the core region. The previously mentioned travel time is particularly critical in the case of actuating devices for use in camshaft adjustment devices, as a fast control-groove engagement is decisively important.

An electromagnetic actuating device with an actuating element movable between two end positions is known from DE 10 2009 015 833 B4, which does not carry any permanent magnet means. The latter are arranged stationarily. In a retracted switching position, the end of a hollow cylinder of a flux-conducting body of the actuating device dips into an annular groove of a pole-body of the device.

DE 10 2006 059 188 A1 shows an electromagnetic actuating device, which has a permanent magnet on its actuating element. The permanent magnet runs parallel to the core region. A possible installation situation of bistable electromagnetic actuating devices is to be drawn from the published document in particular.

Starting from the previously mentioned prior art, the invention is based on the object of specifying an actuating device, which is optimised with regards to the travel time of the actuating element into the end position facing away from the core region and in which at the same time, a return of the actuating element having the permanent magnet means in the direction of the core-region-side end position acts at an earliest possible point in time, i.e. a travel force acts in the direction of the travel initial position at a comparatively large distance from the core region. Furthermore, the object consists in specifying a correspondingly optimised armature assembly and also a camshaft adjustment device with a correspondingly improved bistable electromagnetic actuating device.

SUMMARY OF THE INVENTION

The object is achieved with the camshaft adjustment device having a bistable electromagnetic actuating device having an armature assembly according to the present invention.

The invention has recognised that it is advantageous for the simultaneous improvement of the travel time of the actuating element and for ensuring a large return path on the basis of permanent magnetic attraction forces, to use spring means with a comparatively small spring pitch and preferably a comparatively high maximum spring prestress, as, in contrast with the springs with large spring characteristic gradient that were previously used, spring means with a low spring characteristic gradient deliver additional spring force for accelerating the armature assembly or the actuating element carrying the permanent magnet means, even in the case of large travel or spacing of the actuating element from the core region. In order to be able to use springs of this type, the invention suggests influencing the magnetic-force/travel characteristic of the permanent magnetic force by means of an axial overlapping of the core region and the permanent magnet means such that the permanent magnetic force, which acts between the permanent magnet means and the core region remains at a higher force level over a longer travel, i.e. up to a larger spacing of the permanent magnet means from the core region. This is initially surprising, as faster travel times of the actuating element into the end position facing away from the core region should be achieved, but the permanent magnetic force counteracts this adjustment movement.

Due to the influencing according to the invention, particularly flattening, of the previously mentioned characteristic, which is achieved in a deviation from the flat armature systems used hitherto, by means of the axial overlapping of core region and permanent magnet means or by means of the partial diversion, resulting therefrom, of the magnetic flux past the actual working air gap between the core region and the permanent magnet means, which extends essentially perpendicularly to the adjustment direction of the actuating element, spring means with a comparatively flat spring characteristic layout, i.e. a lower spring constant, can be used in combination with a comparatively high spring tension, springs of this type with a flat spring characteristic transmitting the spring force to the actuating element over a long travel, preferably the entire travel, and consequently accelerate the same for longer. At the same time, the contact or intersection point between spring characteristic and permanent magnet characteristic, i.e. the return point is shifted further to the right, that is to say towards a greater spacing of the permanent magnet means or the actuating element from the core region, so that the armature can already be returned in the direction of the core region at a comparatively earlier point in time by means of the permanent magnet means. This spacing is important insofar as the same is predefined as a rule in the case of camshaft adjustment devices. Furthermore, a larger reliable tolerance range results with regards to the layout of the overall system in the case of an intersection point that is located comparatively far to the right.

Therefore, the demand for ever shorter switching times is fulfilled by the invention and it is ensured at the same time in the case of pulling back the actuating element by means of a rotational movement of the cam, that from the earliest possible point in time, the actuating element is pulled back to the core with the aid of the permanent magnet means and at the same time stresses the spring means in the process.

The configuration according to the invention has proven itself in particular in the case of a bistable electromagnetic actuating device, in which a pole disc made from magnetically conductive material is assigned at least on the axial side facing the core region the permanent magnet, which is preferably arranged on the case side on the preferably piston-shaped actuating element, very particularly preferably disc-shaped, even further preferably annular-disc-shaped and even further preferably axially penetrated by the actuating element, which pole disc is positioned securely with respect to the permanent magnet.

The permanent magnet can be protected in an improved manner by means of the pole disc in the case of the comparatively hard impact of the actuating element on the core region. Particularly preferred is an embodiment of the bistable electromagnetic actuating device, in which in addition to the previously mentioned core-region-side pole disc, a further pole disc is provided on the side, facing away from the core region, of the preferably axially magnetised, permanent magnet, which pole disc, together with the core-region-side pole disc, accommodate the permanent magnet between them in a sandwich-like manner, the pole disc facing away from the core region preferably having the task of magnetic flux diversion in the radial direction, preferably towards or away from a guide housing for the armature assembly.

With regards to the geometric realisation of the axial overlapping of core region and permanent magnet means, there are different options. Particularly preferred is a design variant, in which a pole disc of the permanent magnet means, particularly the pole disc facing the core region (in the core-region-side travel initial position of the actuating element and preferably also in the case of an actuating element already adjusted away from the core region somewhat) radially outwardly encompasses the core region in the axial direction, particularly in that the pole disc is constructed in a pot-shaped manner and/or in that the pole disc axially engages into a core-region-side depression of the core region.

It is also possible that the core region is formed in such a manner that the same engages into a depression of the permanent magnet means, particularly into a depression, for example an annular depression of the pole disc and/or radially outwardly encompasses the permanent magnet means in the axial direction.

Also particularly preferred is a variant, in which the depression, into which the permanent magnet means, particularly a pole disc of the permanent magnet means can engage, is arranged centrally within the core, it being even further preferred if this opening at the same time accommodates the spring means in a region radially inside the overlap.

It has been established to be particularly expedient if the core region and permanent magnet means in the core-region-side end position of the actuating element axially overlap by a distance from a value range between 0.1 mm and 3 mm, preferably between 0.5 mm and 1.5 mm, as a force travel characteristic of the permanent magnet means optimised for the use of a cam shaft adjustment device in particular can thereby be achieved.

With respect to the geometric contouring of the permanent magnet means, particularly the core-region-side pole disc and/or the core region for realising the overlapping, there are different possibilities. It is very particularly preferred, if a corresponding overlap region is constructed in an annular manner and with a closed circumference. It has been established to be particularly expedient, if the overlap region is conically contoured, for example with an externally conical core region and a corresponding internally conical permanent magnet means, or vice versa.

It has been established to be particularly expedient for the use of the actuating device in a camshaft adjustment device, if the spring means comprise compression spring means and/or are constructed as compression spring means, which preferably has a spring constant from a value range between 0.05 N/mm and 3 N/mm, preferably between 0.2 N/mm and 1 N/mm and/or has a prestress force in the core-region-side end position from a value range between 1 N and 20 N, preferably between 4 N and 6 N.

The invention also leads to the use of a previously mentioned actuating device for a camshaft adjustment device and also to a camshaft adjustment device. This comprises at least one cam provided with a control groove, which interacts with the engagement region of the actuating element, wherein the actuating element can be adjusted in the direction of the cam-side end position supported by the spring force of the spring means and can be pulled back from the cam surface by rotation of the cam in the direction of the core-region-side end position.

Furthermore, the invention leads to an armature assembly, particularly for use in an actuating device constructed in accordance with the concept of the invention, very particularly preferably for use in a camshaft adjustment device. The armature assembly is characterised by permanent magnet means, which are constructed and determined to axially overlap a stationary core region not belonging to the armature assembly, but rather to the actuating device, specifically by radially external encompassing in the axial direction and/or by engagement into a preferably annular depression in the core region. To this end, the permanent magnet means have a preferably inner surface section, which preferably extends approximately perpendicularly to the axial adjustment direction of the actuating element and which delimits a working air gap together with a corresponding core region, which is preferably parallel thereto.

Furthermore, for realising the axial overlapping, the permanent magnet means have an overlapping section projecting beyond this surface section axially in the direction of the core region for overlapping the core region by radially outer encompassing and/or by engagement into a depression in the core region. The preceding preferred design of the armature assembly should also be regarded as disclosed in connection with the claimed actuating device.

BRIEF DESCRIPTION OF THE DRAWINGS

Further advantages, features and details of the invention result from the following description of preferred exemplary embodiments, as well as on the basis of the drawings.

In the figures.

In the figures, the same elements and elements with the same function are labelled with the same reference numbers.

DETAILED DESCRIPTION

Figure 1:
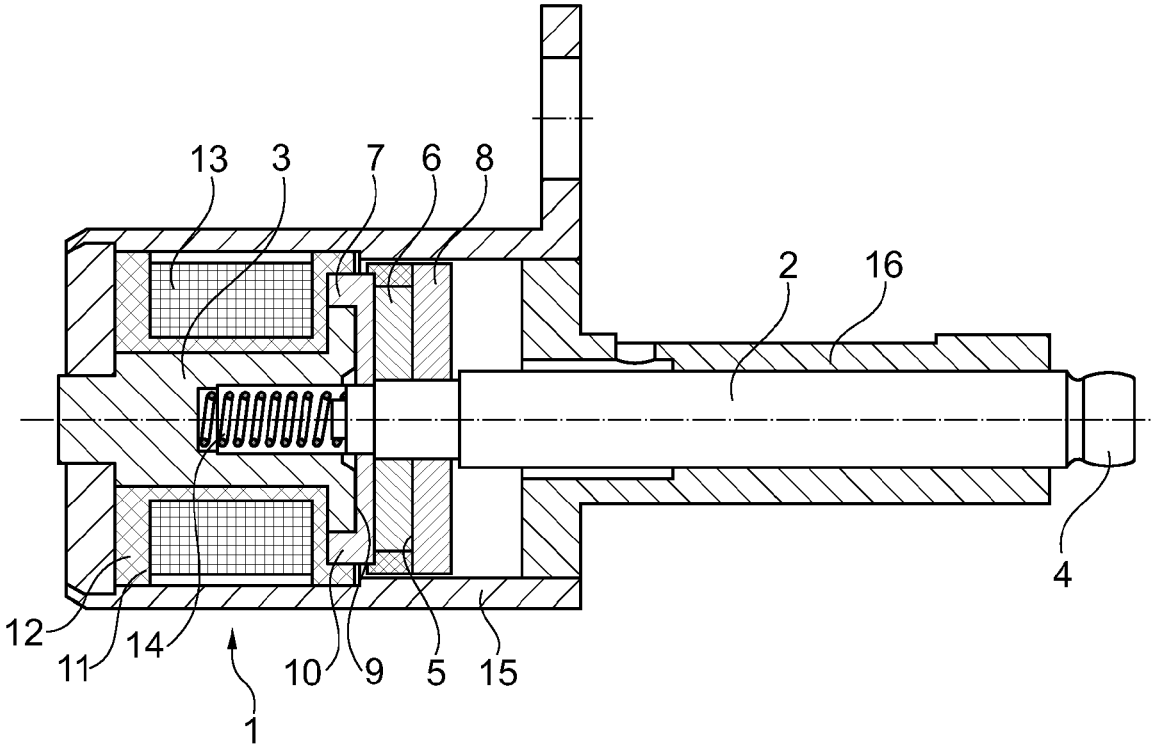
FIG. 1 shows a longitudinal section through an electromagnetic actuating device according to a preferred embodiment.

An electromagnetic actuating device 1 for use in a camshaft adjustment device is shown in FIG. 1. In terms of its fundamental construction, the actuating device corresponds to the actuating device shown in FIG. 1 of DE 201 114 466 U1, so that with respect to the commonalities, reference is made to the description of figures relating to the same, which should be considered as disclosed as belonging to the disclosure of the present application. The important difference from the actuating device from the prior art consists in the fact that core region and permanent magnet means axially overlap in the core-side end position and are not operated as in the prior art with a flat armature assembly.

At the same time, the spring means are dimensioned differently—the spring means in the embodiment shown here preferably have a higher prestress force and a lower spring constant. In detail:

The electromagnetic actuating device 1 comprises a piston-like actuating element 2 movable between a core-region-side travel initial position and an axially spaced travel end position, which actuating element has an engagement region 4 for dipping in a control groove of a cam, which is not illustrated, of an internal combustion engine in the region of its end facing away from a stationary core region 3. The actuating element 2 carries permanent magnet means 5 on the case side, comprising a disc-ring-shaped, axially magnetised permanent magnet 6 and also two pole discs, which accommodate the permanent magnet 6 axially between them and which are likewise arranged at the cover side on the actuating element 2, which axially penetrates the permanent magnet means 5. These are first a core-region-side pole disc 7 and an engagement-region-side pole disc 8. The engagement-region-side pole disc 8 is used for diverting the magnetic flux in the radial direction. The core-region-side pole disc 7 has a characteristic adaptation function and a stabilising function, as in the exemplary embodiment shown, the same comes into direct interaction with the core region 3.

As emerges from FIG. 1, the core-region-side pole disc 7 is shaped in a pot-shaped manner and has a radially inner surface section 9, which extends perpendicularly to the longitudinal extent of the actuating element 2, and which delimits a working air gap with the opposite parallel surface of the core region 3. An overlapping section 10 axially projects beyond the surface section 9, which overlapping section is formed by an annular wall and which, in the end position shown, encompasses the core region 3 laterally, here radially outwardly in the axial direction, so that a part of the magnetic flux flows via this overlapping region 10, as a result of which the resulting permanent-magnetic retaining force between the permanent magnet means 5 and the core region 3 is maintained or remains at a high level over a longer travel in the direction of the opposite end position.

Located in a region radially adjacent to the core region 3 is a coil apparatus 11 with coil carrier 12 and coil 13 that can be powered, the powering of which effects a movement of the actuating element 2 away from the core region 3 in the direction of the cam. This adjustment movement is supported by spring means 14 formed by a compression spring, which is accommodated in a central opening of the core region 3 in the exemplary embodiment shown and which is axially supported on the core region and on the actuating element 2. In the case of an adjustment movement of the actuating element 2, the spring means 14 are axially prestressed by the same up to a maximum prestress force, which is chosen to be as high as possible. At the same time, the force-path characteristic of the spring means 14 is comparatively flat, in order to achieve acceleration support of the actuating element 2 for as long as possible. A spring means design 14 of this type is possible on the basis of the overlapping according to the invention of core region 3 and permanent magnet means 5.

In the exemplary embodiment shown, the permanent magnet means 5 are guided on the internal circumference of a magnetically conductive housing 15 and the actuating element 2 is guided on a sleeve section 16 of the housing, which is separate by way of example in the exemplary embodiment shown.

Figure 2A:
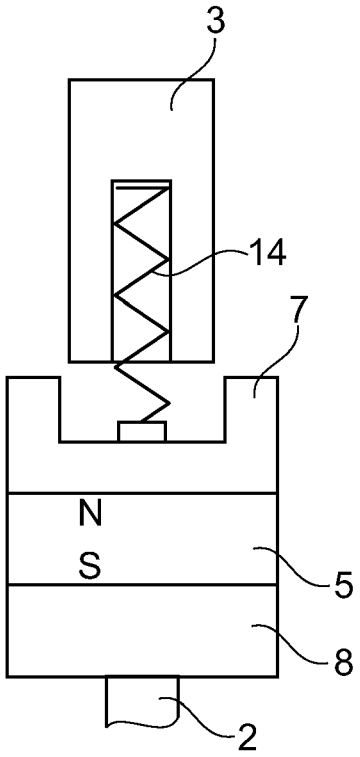
FIG. 2*a* shows a strongly schematised view of an armature assembly and a core element, it being possible for permanent magnet means and core region to axially overlap in a travel initial position.

A configuration of core region 3 and actuating element 2 with permanent magnet means 5 is shown in FIG. 2*a* in a strongly simplified manner. The core-region-side, pot-shaped pole disc 7 for overlapping interaction with the core region 3 can be seen. Here, various configurations are conceivable. Instead of or in addition to the radially outer axial encompassing of the core region, the permanent magnet means 5 can engage into a for example annular or central opening in the core region 3. Likewise, the core region can be constructed encompassing the permanent magnet means 5 radially outwardly in the axial direction or engaging into a, for example annular opening in the permanent magnet means 5, for example in the pole disc 7. Also, the geometric configuration of the overlapping region can be realised differently from that schematically illustrated, for example in a conically contoured manner.

Figure 2B:
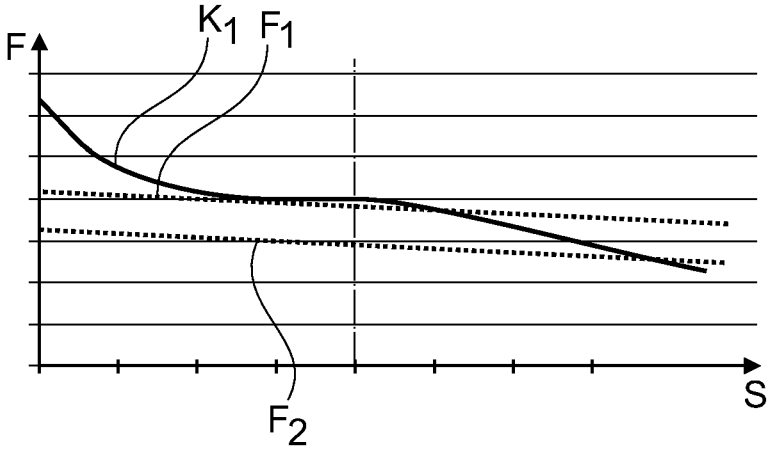
FIG. 2*b* shows an associated permanent-magnetic-force-travel characteristic.

An associated permanent force is shown in FIG. 2*b* in a force or travel (F)/path (s) characteristic K1. A flattened region of the characteristic can be seen after an initial sharply falling region. This flattening (saddle or terrace section) is achieved by means of the axial overlapping. As a result, it is possible to use a spring with a spring characteristic F1 with comparatively high prestress force and flat curve. For example, in the region of the perpendicular dashed line, the spring means 14 are pulled in the direction of the core-region-side end position, exclusively owing to the permanent magnet force action of the permanent magnet means 5. Due to the flat configuration of the spring characteristic, acceleration support of the actuating element is achieved over the entire travel thereof in the direction of the camshaft-side end position.

Also drawn in on the graph is a spring characteristic of a spring with a lower prestress force, which is not to be preferred, the same spring constant having been chosen for reasons of simplification. This spring would lead to a lower acceleration effect.

Figure 3A:
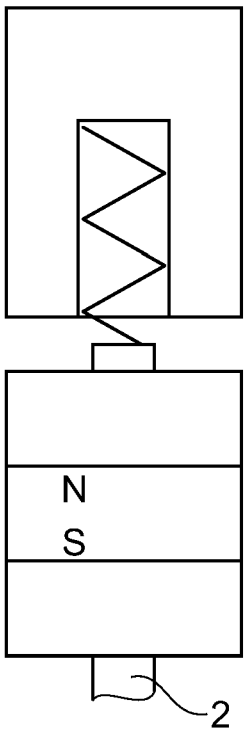
FIG. 3*a* shows an arrangement made up of armature assembly with permanent magnet means and also an opposite core region according to the prior art, the arrangement being realised as a flat armature system here.
Figure 3B:
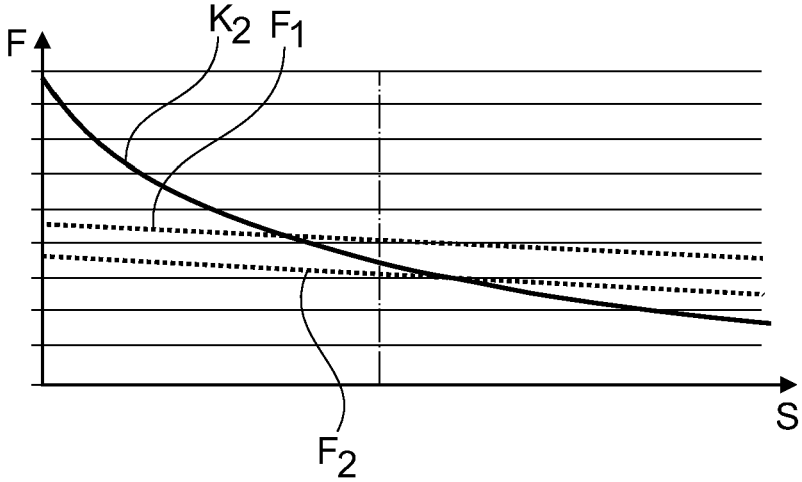
FIG. 3*b* shows an associated magnetic-force-travel characteristic.

If one then compares the configuration measured in FIGS. 2*a* and 2*b* with the prior art configuration according to FIGS. 3*a* and 3*b*, one can see the advantage of a configuration according to the invention. The arrangement made up of an actuating element 2 with permanent magnet means 5 is shown in FIG. 2*a*, the arrangement being arranged as a flat armature system, i.e. the permanent magnet means do not interact with the core region in an overlapping manner. This results in the hyperbolic characteristic K2, shown in FIG. 3*b*, of the permanent magnet means in the permanent magnetic force (F) travel (s) graph according to FIG. 3*b*. To clarify the advantages of the invention compared to the prior-art embodiment, the same spring characteristics F1, F2 are drawn in, the spring characteristic F1 intersecting the hyperbolic characteristic K2 after an already very short travel, so that a spring with the spring characteristic F2 must be chosen, in order to be able to comply with the same return point illustrated dashed and perpendicularly, which return point is often predetermined by the system.

This then leads however to the spring with the low prestress force and thus to a poorer acceleration support of the actuating element in the direction away from the core region.

Figure 4:
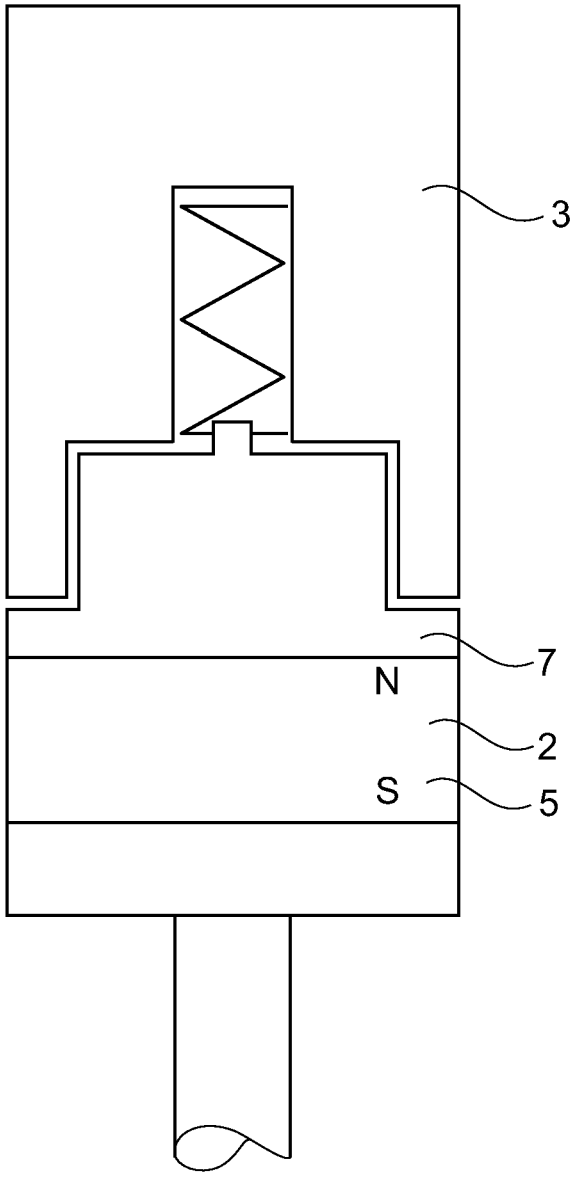
FIG. 4 shows an alternative arrangement of armature assembly with permanent magnet means, wherein the actuating element axially dips into a corresponding depression of the core region here.

A further alternative configuration of core region 3 and actuating element 2 with permanent magnet means 5 is shown in FIG. 4 in a greatly simplified manner. In contrast with the exemplary embodiment according to FIG. 2*a*, the core region is here shaped in a pot-shaped manner and the core-region-side pole disc 7 axially projects into the pot formed by the core region 3, centrally to be specific. In the exemplary embodiment shown, the actuating element, more precisely the pole disc 7 or the axial extension thereof is guided in the core region.

The invention claimed is:

1. A camshaft adjustment device comprising a cam of an internal combustion engine, the cam has a control groove, and a bistable electromagnetic actuating device (1) with an actuating element (2) having an engagement region (4) at the end side and axially movable between two end positions for engagement into the control groove of the cam, a coil apparatus (11) provided stationarily relatively to the actuating element (2) and constructed for exerting a force onto the actuating element, the actuating element (2) has permanent magnet means (5), which are constructed for interacting with a core region (3) provided stationarily relatively to the actuating element (2), the coil apparatus (11) is constructed for generating a counter force counteracting a retaining force of the permanent magnet means (5) and releasing the permanent magnet means from the core region (3) as a reaction to an electronic control signal, spring means (14) are provided and arranged such that they load the actuating element (2) with spring force in an axial direction pointing away from the core region (3), the permanent magnet means (5) have at least one axially magnetised permanent magnet (6) and a pole disc (7) made from magnetically conductive material on the side facing the core region (3) and comprise a pole disc (7) made from magnetically conductive material and facing away from the core region (3), and the actuating element (2) is adjusted into an end position by powering the coil apparatus (11), wherein, when in the end position, the actuating element engages by means of the engagement region (4) thereof into the control groove and is accelerated by the cam by means of the rotation thereof in the direction of a core-region-sided initial position of travel, wherein the spring means (14) are maximally prestressed by means of the actuating element (2), and wherein the core region (3) and the pole disc (7) of the permanent magnet means (5), on the side facing the core region, overlap in the core-region-sided initial position of travel in the axial direction for influencing the return point.

2. The camshaft adjustment device according to claim 1, wherein the pole disc (7) of the permanent magnet means (5), which pole disc faces the core region (3), is shaped and arranged radially outwardly encompassing the core region (3) in the axial direction and/or axially engaging into a core-region-sided depression of the core region (3).

3. The camshaft adjustment device according to claim 2, wherein the pole disc (7, 8) is contoured in a pot-shaped manner and a pot wall axially encompasses the core region (3) and engages into the core-region-sided depression.

4. The camshaft adjustment device according to claim 1, wherein the core region (3) is shaped and arranged radially outwardly axially encompassing the permanent magnet means (5) and axially engaging into a permanent-magnet-means-side comprising a depression of the permanent magnet means (5).

5. The camshaft adjustment device according to claim 1, wherein the core region (3) and permanent magnet means (5) in a core-region-sided end position are constructed axially overlapping over a distance measured in the axial direction from a value range between 0.1 mm and 3 mm.

6. The camshaft adjustment device according to claim 1, wherein an axial, annular, overlapping section (10) of the permanent magnet means (5) and/or of the core region (3) is contoured with a closed circumference.

7. The camshaft adjustment device according to claim 1, wherein the spring means (14) comprise compression spring means which has a spring constant from a value range between 0.05 N/mm and 3 N/mm.

* * * * *